US005090923A

United States Patent [19]

Kenyon et al.

[11] Patent Number: 5,090,923

[45] Date of Patent: Feb. 25, 1992

[54] DEDICATED CONTACT AID FOR CONNECTORS UTILIZING HIGH SPEED INSTALLATIONS

[75] Inventors: Lee G. Kenyon, Mississauga; Thomas C. Murray, Aurora, both of Canada

[73] Assignee: Burndy Corporation, Norwalk, Conn.

[21] Appl. No.: 589,618

[22] Filed: Sep. 28, 1990

[51] Int. Cl.[5] ..... H01R 4/08

[52] U.S. Cl. ..... 439/783; 174/94 R; 403/314; 439/936

[58] Field of Search ..... 439/783, 204, 521, 863, 439/936; 174/79, 90, 94 R, 94 S; 403/211, 314, 374, 391; 24/136 R

[56] References Cited

U.S. PATENT DOCUMENTS

| | | | |
|---|---|---|---|
| 2,045,547 | 6/1936 | Chatfield | 174/94 S |
| 2,560,411 | 7/1951 | Burns | 174/94 R |
| 2,624,772 | 1/1953 | Phillips . | |
| 2,901,722 | 8/1959 | Arnott, Jr. | 174/94 R |
| 3,157,735 | 11/1964 | Stroup et al. | 439/199 |
| 3,235,944 | 2/1966 | Broske et al. | 439/863 |
| 3,257,499 | 6/1966 | Broske | 439/94 R |
| 3,387,080 | 6/1968 | Dibble et al. | 174/94 R |
| 3,673,312 | 6/1972 | Vockroth | 24/136 R |
| 4,035,903 | 7/1977 | Taggart | 29/458 |
| 4,123,133 | 10/1978 | Pickett et al. | 403/275 |
| 4,650,273 | 3/1987 | Boosdrop | 439/783 |
| 4,723,920 | 2/1988 | Werner | 439/782 |
| 4,730,087 | 3/1988 | Werner | 174/94 S |

FOREIGN PATENT DOCUMENTS

| | | | |
|---|---|---|---|
| 917244 | 3/1982 | U.S.S.R. | 439/863 |

*Primary Examiner*—Neil Abrams

*Attorney, Agent, or Firm*—Hoffman, Wasson & Gitler

[57] ABSTRACT

A method and apparatus for preventing birdcaging of a conductor having multiple strands when these conductors are installed in a connector utilizing high speed installations, such as by an explosively-operated tool. The inside surface of the connector is coated with a mixture of 30% silica sand and 70% of PENETROX ® A13 to reduce contact resistance. A wedge is then inserted into the connector between the conductors utilizing the explosively driven tool.

3 Claims, 3 Drawing Sheets

DEDICATED CONTACT AID FOR CONNECTORS UTILIZING HIGH SPEED INSTALLATIONS

In many instances, such as when a tap wire is run from a permanently-installed main power cable, a sleeve-like connector member is provided around the wire and the cable and a wedge is driven, with considerable force, between the cable and the tap wire provided inside of the sleeve-like connector. An installation tool which can be utilized to drive the wedge between the cable and the tap wire is described in U.S. Pat. No. 33,098 issued to Center. Unfortunately, the rapid acceleration of this wedge causes the various conductors provided in the wire or the cable to be dragged in the direction of the wedge, relative to the stationary sleeve member. As a result of this cable movement and the high-contact force which is generated between the conductors and the sleeve member, the individual cable strands are pulled at different rates, resulting in a phenomena called "birdcaging".

Birdcaging is a form of cable damage that results in reduced ampacity of the conductor. This phenomena should also be avoided since it permits debris, moisture, salt spray, atmospheric gases or the like to lodge in the conductor and promote corrosion. Additionally, when birdcaging results on insulated wires, it tends to rupture the insulation. Historically, when birdcaging occurs, it is common practice to fill space between the stands with a epoxy resin or some other suitable material to prevent the entrance of moisture, corrosion and other corrosion inducing materials.

A number of contact aids are commercially available for electrical connectors and are designed to reduce the contact resistance between the connector and the conductor, and to prevent the ingress of contamination in the contact zone. While these contact aids are well suited for compression or mechanical type installation, they do not prevent cable damage in high speed connector type installations. Although U.S. Pat. No. 3,235,944 issued to Broske et al., indicates that birdcaging can be avoided by using an explosively driven device to drive the wedge, it is determined that birdcaging can still result during this process.

Consequently, it is an object of the present invention to provide a process as well as a structure for avoiding the occurrence of this birdcaging phenomena even when the wedge or other device is driven in by a high speed or explosively driven device.

SUMMARY OF THE INVENTION

The present invention overcomes the deficiencies of the prior art by applying a contact aid to certain surfaces of the sleeve-like member. This contact aid can consist of a silica compound suspended in a PENETROX® A13 joint compound manufactured by the Burndy Corporation of Norwalk, Connecticut. This particular composition increases the co-efficient of friction between the conductors or cables and the sleeve-like member. This would allow the co-efficient of friction to be the same between the cable and the wedge, as well as between the cable and the sleeve-like member to prevent individual strand pulling resulting in birdcaging.

These objects and other features, aspects and advantages of the present invention will become more apparent from the following detailed description of the present invention when taken in conjunction with the accompanying drawings.

DETAILED DESCRIPTION OF THE INVENTION

Figure 1:
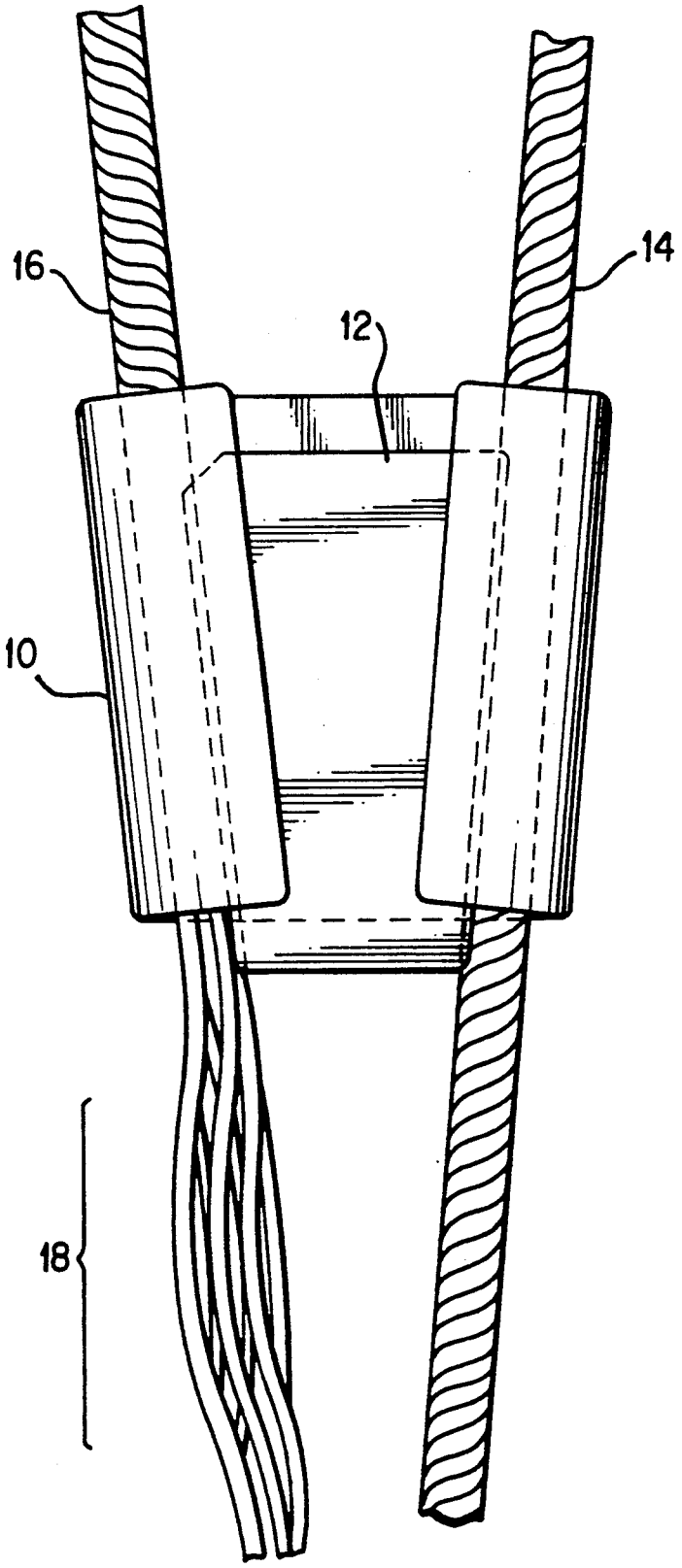
FIG. 1 PRIOR ART
FIG. 1 is a top view of a C-connector member illustrating the birdcaging phenomena.

FIG. 1 illustrates a typical C-shaped connector 10 which encloses two multi-strand conductors 14 and 16 positioned on either side of a wedge 12. When the wedge 12 is explosively driven into the C-shaped connector 10 to position the conductors 14 and 16 between the wedge and the connector, the birdcaging phenomena 18 often results. As previously indicated, although there are a number of contact aids which are commercially available for electrical connectors to reduce the contact resistance between the connector and conductor, these contact aids are not well suited for high-speed wedge-type installations, and they do not prevent the occurrence of the birdcaging phenomena.

Figure 2:
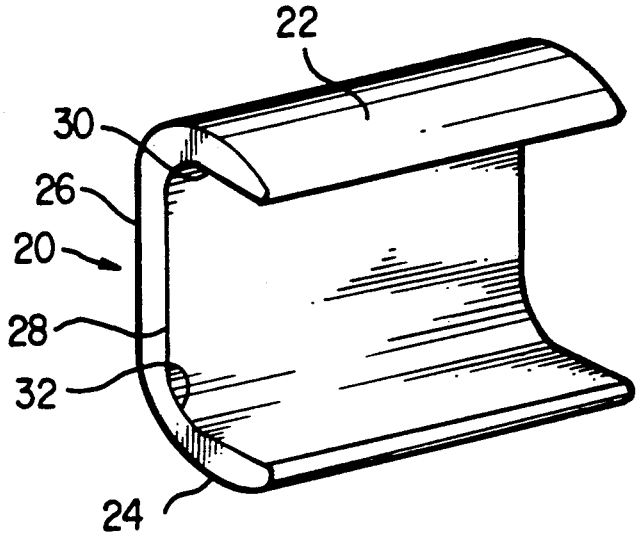
FIG. 2 is a perspective view of the C-shaped connector member.
Figure 3:
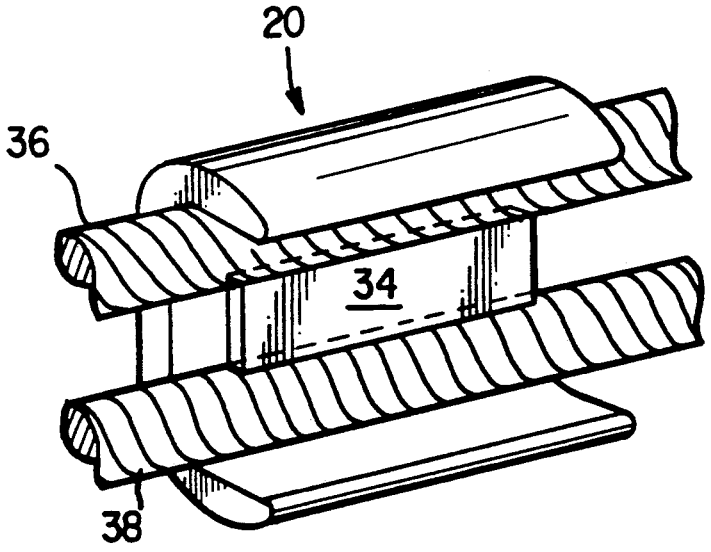
FIG. 3 is a perspective view of the connector shown in FIG. 2 secured to a pair of conductors.
Figure 4:
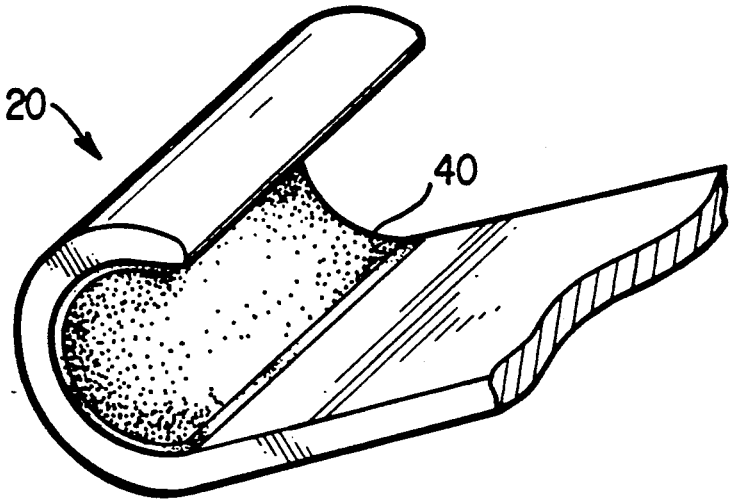
FIG. 4 is a perspective view of the C-shaped connector member provided with a contact aid coating.

A typical C-shaped connector 20 which can utilize the contact aid of the present invention is shown in FIGS. 2 and 3. This connector consists of a top outer surface 22, a bottom outer surface 24 and an outer surface 26 connecting the top and bottom surfaces to one another to form a connector in the shape of a "C". The inside surface of this connector 20 is provided with upper and lower radii surfaces 30, 32 as well as a flat surface 28 joining these radii surfaces together. When included with a standard wedge 34, a connector is formed provided with conductors 36 and 38 therein.

Figure 5:
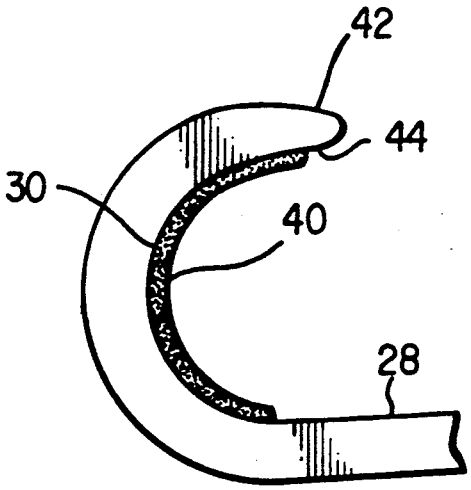
FIG. 5 is a side view of the C-shaped connector member shown in FIG. 4.

The contact aid of the present invention comprises a mixture of approximately 30%, by weight of silica sand and 70% by weight of PENETROX® A13. PENETROX® A13 consists of a synthetic base vehicle in which zinc particles are suspended. This mixture 40 is applied to the inner surface of the C-connector 20 along the radii where the conductor comes into contact with the connector. As shown in FIG. 5, this mixture should not extend onto the flat portion 28 of the connector, but can extend to a position 42 approaching the radius section 44 of the champered end surface of the connector.

While this invention has been described with particular reference to the specific embodiments described herein, it may also be embodied in a variety of forms diversed from those specifically shown and described, without departing from the spirit and scope of the invention.

What is claimed is:

1. A method of securing a pair of electrical conductors to a connector without creating a birdcaging effect, comprising the steps of:

coating a portion of the inner surface of the connector with a material comprising a mixture consisting of 30% by weight of silica sand and 70% by weight of a synthetic base vehicle in which zinc particles are suspended to reduce the contact resistance between the connector and the conductors; and inserting a wedge member into the connector between the two conductors utilizing an explosively driven tool.

2. The method in accordance with claim 1 in which the contact resistance material is applied only to the radius sections of the connector.

3. A C-configured connector used to prevent bird-caging when a wedge is explosively propelled therein, the C-shaped connector provided with an inner surface having first and second radius sections connected to an inner flat section, and a material comprising a mixture consisting of 30% by weight of silica sand and 70% by weight of a synthetic base vehicle in which zinc particles are suspended applied to the inner surface of the C-shaped member, said material used to reduce the contact resistance between the conductors and the C-shaped connector.

* * * * *